US008312756B2

(12) United States Patent
Swinford

(10) Patent No.: US 8,312,756 B2
(45) Date of Patent: Nov. 20, 2012

(54) HYDROPNEUMATIC RIVETER

(76) Inventor: Mark Douglas Swinford, Centerville, OH (US)

( * ) Notice: Subject to any disclaimer, the term of this patent is extended or adjusted under 35 U.S.C. 154(b) by 0 days.

(21) Appl. No.: 13/030,527

(22) Filed: Feb. 18, 2011

(65) Prior Publication Data

US 2012/0210550 A1 Aug. 23, 2012

Related U.S. Application Data

(66) Substitute for application No. 12/706,671, filed on Feb. 16, 2010, now abandoned.

(51) Int. Cl.
*B21J 15/34* (2006.01)
*B21D 39/00* (2006.01)

(52) U.S. Cl. ..... 72/453.19; 72/391.6; 29/243.53; 29/812.5

(58) Field of Classification Search ..... 72/391.6, 72/453.16, 453, 17, 453.19; 29/243.525, 29/243.53, 243.54, 812.5
See application file for complete search history.

(56) References Cited

U.S. PATENT DOCUMENTS

| | | | | |
|---|---|---|---|---|
| 2,140,658 | A | 1/1939 | Van Sittert | |
| 2,317,224 | A * | 4/1943 | Rylander | 29/243.54 |
| 2,396,562 | A | 3/1946 | Forss | |
| 2,865,212 | A | 12/1958 | Fischer et al. | |
| 3,037,208 | A | 6/1962 | Haberstump | |
| 3,082,898 | A | 3/1963 | Bosch | |
| 3,328,985 | A | 7/1967 | Keymer | |
| 3,367,166 | A * | 2/1968 | Newton et al. | 72/453.17 |
| 3,541,792 | A * | 11/1970 | Ellis, Jr | 60/534 |
| 3,580,457 | A * | 5/1971 | Henshaw | 29/818 |
| 4,027,520 | A | 6/1977 | Klein | |
| 4,062,217 | A * | 12/1977 | Ebbert et al. | 29/243.525 |
| 4,088,003 | A | 5/1978 | Schwab | |
| 4,089,202 | A | 5/1978 | Schwab | |
| 4,116,036 | A * | 9/1978 | Sheffield et al. | 29/243.525 |
| 4,120,188 | A | 10/1978 | Schwab | |
| 4,263,801 | A | 4/1981 | Gregory | |
| 4,275,583 | A * | 6/1981 | Gilbert et al. | 29/243.525 |
| 4,515,005 | A | 5/1985 | Klein | |
| 4,580,435 | A | 4/1986 | Port | |
| 4,821,555 | A | 4/1989 | Kamata | |
| 4,903,522 | A * | 2/1990 | Miller | 29/243.525 |
| 5,653,368 | A * | 8/1997 | Miles et al. | 29/243.53 |
| 6,256,854 | B1 * | 7/2001 | Chitty et al. | 29/243.53 |
| 6,704,986 | B1 | 3/2004 | Liu | |
| 7,024,742 | B2 * | 4/2006 | Woyciesjes et al. | 29/243.53 |
| 7,219,526 | B2 | 5/2007 | Herod | |
| 7,290,431 | B1 | 11/2007 | Spivak | |

* cited by examiner

*Primary Examiner* — David B Jones
(74) *Attorney, Agent, or Firm* — Thomas E. Lees, LLC

(57) ABSTRACT

A hydropnuematic riveter system is described, having features that allow for a reduction in size and weight over traditional rivet squeezers and rivet pullers. The riveter system also provides for greater versatility by permitting the operator to connect different rivet forming heads to the pressure intensifier portion, via a single flexible conduit with fluid-tight quick disconnect fittings.

20 Claims, 8 Drawing Sheets

HYDROPNEUMATIC RIVETER

CROSS REFERENCE TO RELATED APPLICATIONS

Not Applicable

STATEMENT REGARDING FEDERALLY SPONSORED R&D

Not Applicable

REFERENCE TO A SEQUENCE LISTING

Not Applicable

FIELD OF THE INVENTION

The present invention relates to rivet forming tools, or tools serving a similar function, powered by a combination of air pressure and hydraulic pressure.

BACKGROUND OF THE INVENTION

The invention relates to rivet forming tools, historically used in the aerospace industry or other industries during the process of joining metal sheets together by compressing solid metal rivets or by pulling blind rivets.

Several different types of tools exist for forming the heads of rivets, in order to join sheet metal parts into an assembled unit. These include rivet guns/bucking bars, hand squeezers, hand blind riveters, pneumatic squeezers and pneumatic blind riveters. Of these types, pneumatic squeezers and pneumatic blind riveters produce the most consistently formed rivets with the least operator fatigue. Pneumatic rivet squeezers have been used for many years. There are two basic types; C-yoke and Alligator type squeezers. C-yoke types allow for different yokes to be used, dependent on the geometry of the parts to be fastened, while Alligator types allow the tool squeezer jaws to get into tighter areas.

The inventor of the present invention, while assembling an amateur built aircraft kit, discovered several limitations of present pneumatic squeezers. The inventor undertook designing a new riveter which would overcome these limitations. The invention disclosed represents a preferred embodiment of the basic configuration, but not all possible embodiments.

BRIEF SUMMARY OF THE INVENTION

Pneumatic riveters of the known art are durable and reliably form rivets, or perform alternate operations such as crimping, swaging, staking and hole punching. One of the earliest examples is represented by U.S. Pat. No. 2,140,658 by Paul Van Sittert. These riveters come in various sizes and configurations in order to accommodate a myriad of riveting requirements typically found on aircraft of metallic construction. U.S. Pat. No. 7,219,526 by James Herod is a recent example of an alligator type squeezer, in this case incorporating composite materials to minimize weight. The riveters are able to generate several thousand pounds of force, necessary for compressing or pulling typical rivets, using a relatively low air pressure supply of approximately 90 psi. Notwithstanding the effectiveness of existing riveters, these riveters have several disadvantages, which the present invention remedies.

A first disadvantage of existing riveters is the inability to access some tightly confined areas, such as internal wing structures. This is a result of packaging the riveter into an integrated unit, whereby the portion of the unit forming the rivet head and the portion of the unit creating the force are rigidly joined. Although recent inventions have attempted to minimize the size of the unit, such as that for an alligator type squeezer detailed in U.S. Pat. No. 7,290,431 by Boris Spivak, the size of these units still prohibit access to some confined structural areas. Other types of riveters also have a need for compactness, as evidenced by a hydropneumatic blind riveter detailed in U.S. Pat. No. 6,704,986 by Pao-Fang Liu. However, despite an attempt to allow for greater flexibility of the unit referenced by employing a rotational head, the unit is still prohibited from very confined areas, and it makes for a relatively heavy unit for the operator to hold.

A primary object of the present invention is to create a highly compact and lightweight riveter. The present invention accomplishes this by separating the force generation portion (pressure intensifier) of the riveter from the rivet forming portion (forming head) of the riveter. Control of the riveter is packaged at the force generation portion to further reduce the size and weight of the forming portion. The pressure intensifier of the riveter comprises a low pressure air actuated piston, which is attached to a high pressure hydraulic piston. The forming head of the present invention comprises a piston housing and a moving piston, which interfaces with the rivet to be compressed or pulled. The two portions are connected via a flexible metal-braided conduit and a quick disconnect fitting may also be employed. By separating these two portions, the forming head of the present invention can fit into more tightly confined areas, and the riveter is lighter for the operator to hold. The weight reduction for the rivet squeezer forming head of the present invention is approximately 3 lb, or 60% of the weight of a pneumatic squeezer with similar force capability. Those skilled in the art can readily appreciate the advantages of such a compact and lightweight riveter.

Another object of the present invention is to produce a riveter with a constant actuation force. The rivet squeezer of the present invention utilizes a compression pin driven by hydraulic pressure only, and as such the force does not vary with varying rivet lengths. This is in contrast to rivet squeezers of the known art, whereby the compression force varies as the rivet is squeezed. The variability is due to the fact that the rivet is compressed by a pin or jaw which is further driven by an air piston driven profiled wedge. As the interfacing tip of the pin or jaw moves in relation to the profiled wedge, the mechanical advantage changes. For a ⅛ inch rivet being squeezed, it is necessary to upset the shank of the rivet by approximately 0.110 inch. However the inventor has found that a typical pneumatic squeezer force may drop from 3,800 lbf to only 2,000 lbf in 0.030 inch of travel of the profiled wedge. Those skilled in the art will recognize that this variability may require the operator to make additional adjustments to the squeezer, or require the operator to squeeze the rivet twice to set the final rivet head size.

A further object of the present invention is to produce a riveter which is more cost effective, by offering greater flexibility to the operator. The present invention allows the operator to purchase one force generation portion to power a variety of rivet forming portions, thereby saving the expense of multiple force generation portions. A disadvantage of existing riveters is related to their intrinsic inseparable assembly. Since the force generation portion and forming head portion of these riveters are inseparable, the end user is essentially buying additional force generation portions each time a different forming head is needed, which results in a higher cost burden to the operator.

Thus, for the aforementioned reasons those skilled in the art will readily appreciate that the hydropneumatic riveter of the present invention offers distinct advantages over traditional pneumatic and hydropneumatic riveters.

DETAILED DESCRIPTION OF THE INVENTION

Figure 1:
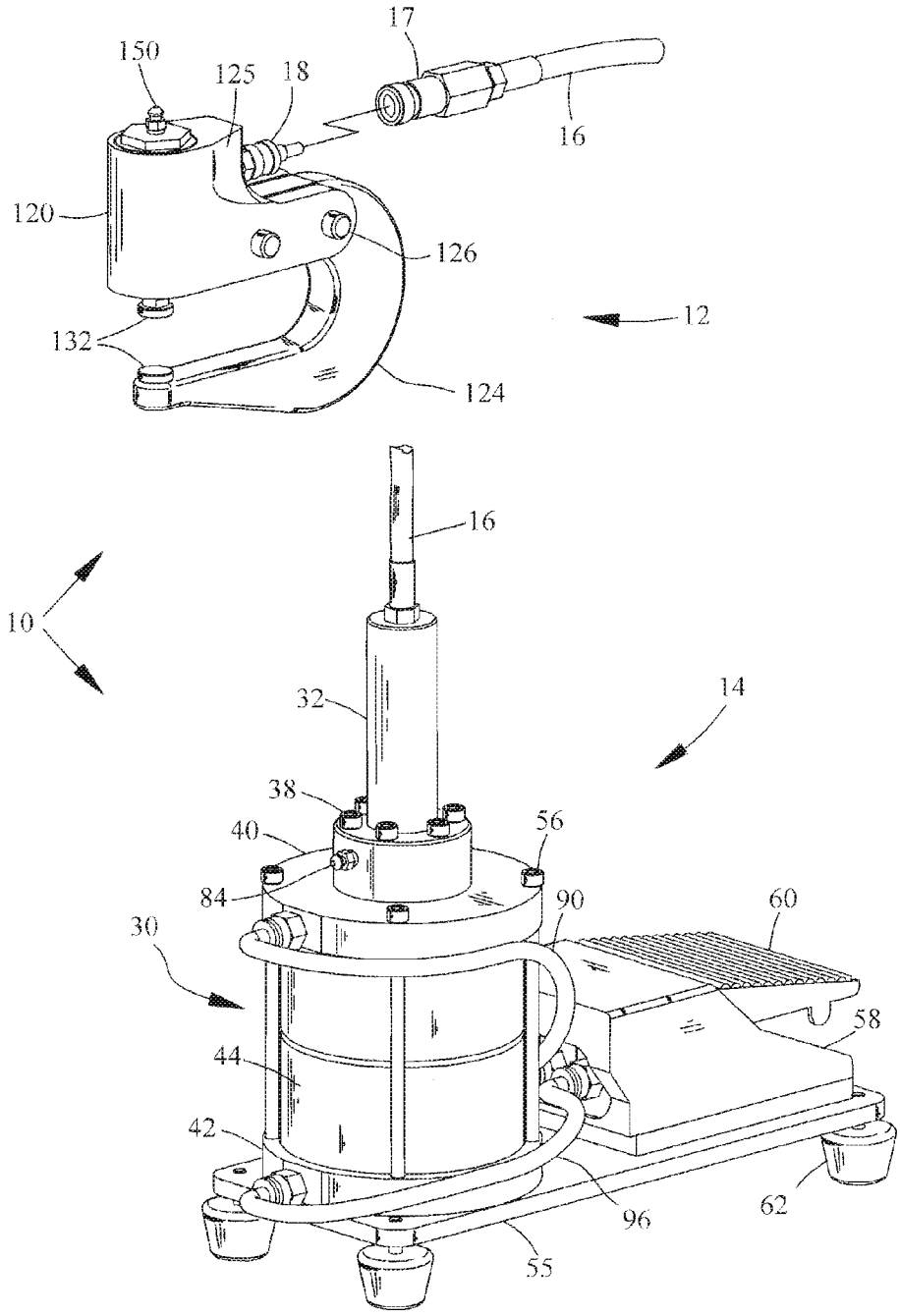
FIG. 1 is a perspective view of the riveter, with a C-yoke forming head portion attached to a pressure intensifier portion via a flexible conduit. The conduit is approximately six feet in length and is therefore not shown in its entirety.

According to a preferred embodiment of the invention, there is described a hydropneumatic riveter having features that allow for a more compact size, lower weight, consistent force and greater versatility. Referring to FIG. 1, a hydropneumatic riveter 10 can be generally divided into two main sub-assemblies; a forming head 12 and a pressure intensifier 14. The forming head 12 shown in FIG. 1 is a C-yoke type, so named due to the shape of the anvil which forms the rivet. The two sub-assemblies are interconnected via a flexible wire-braided reinforced conduit 16, which may comprise a fluid-tight female quick disconnect 17. The conduit 16 is generally permanently attached to the pressure intensifier 14, but could alternately be permanently attached to the forming head 12. The forming head 12 may likewise comprise a fluid-tight male quick disconnect 18, for selectively coupling and uncoupling the forming head 12 from the conduit 16 attached to the pressure intensifier 14. The conduit 16, female disconnect 17 and male disconnect 18 are capable of withstanding pressures of up to 4,000 psi. The female disconnect 17 and male disconnect 18 prevent fluid leakage during connection and disconnection, and minimizes air inclusion during those processes.

Figure 2:
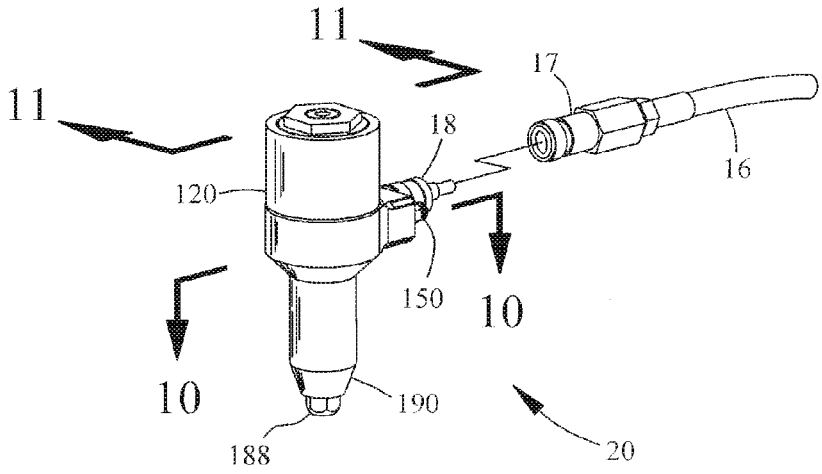
FIG. 2 is a perspective view of a blind rivet forming head portion, which may be attached to the pressure intensifier portion of the riveter shown in FIG. 1 via a flexible conduit.
Figure 3:
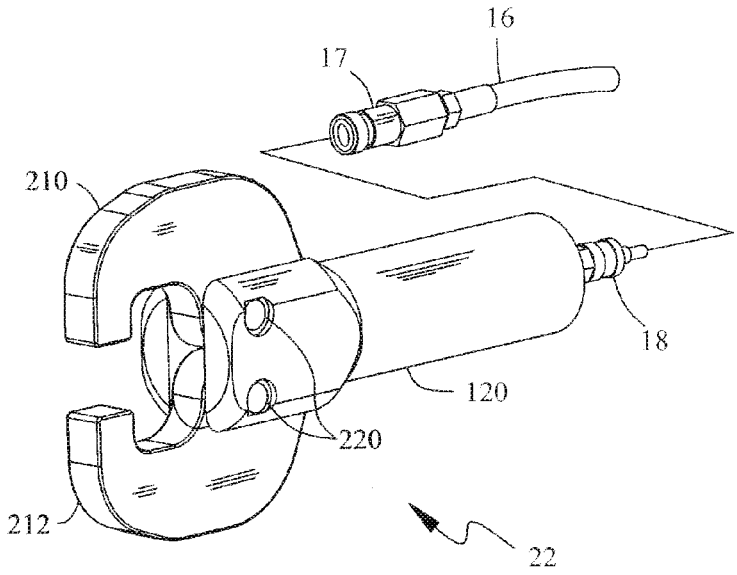
FIG. 3 is a perspective view of an alligator forming head portion, which may be attached to the pressure intensifier portion of the riveter shown in FIG. 1 via a flexible conduit.

The pressure intensifier 14 may be used to power alternate types of rivet forming heads, as depicted in FIGS. 2 and 3. The intensifier 14 is sized so that it displaces a volume of pressurized fluid that meets the flow requirements of the various forming heads. A blind rivet forming head 20 is shown in FIG. 2. This type of rivet former is useful for installing blind type rivets, also known commercially as "pop" rivets. An alligator forming head 22 is shown in FIG. 3. Alligator riveters typically have an advantage over C-yoke type rivet squeezers in that the jaws of an alligator riveter can be inserted into more confined areas. It should however be noted that the C-yoke forming head 12 of the present riveter invention 10 can often fit into equally confined areas, and sometimes more confined areas depending on the surrounding structure.

Figure 4:
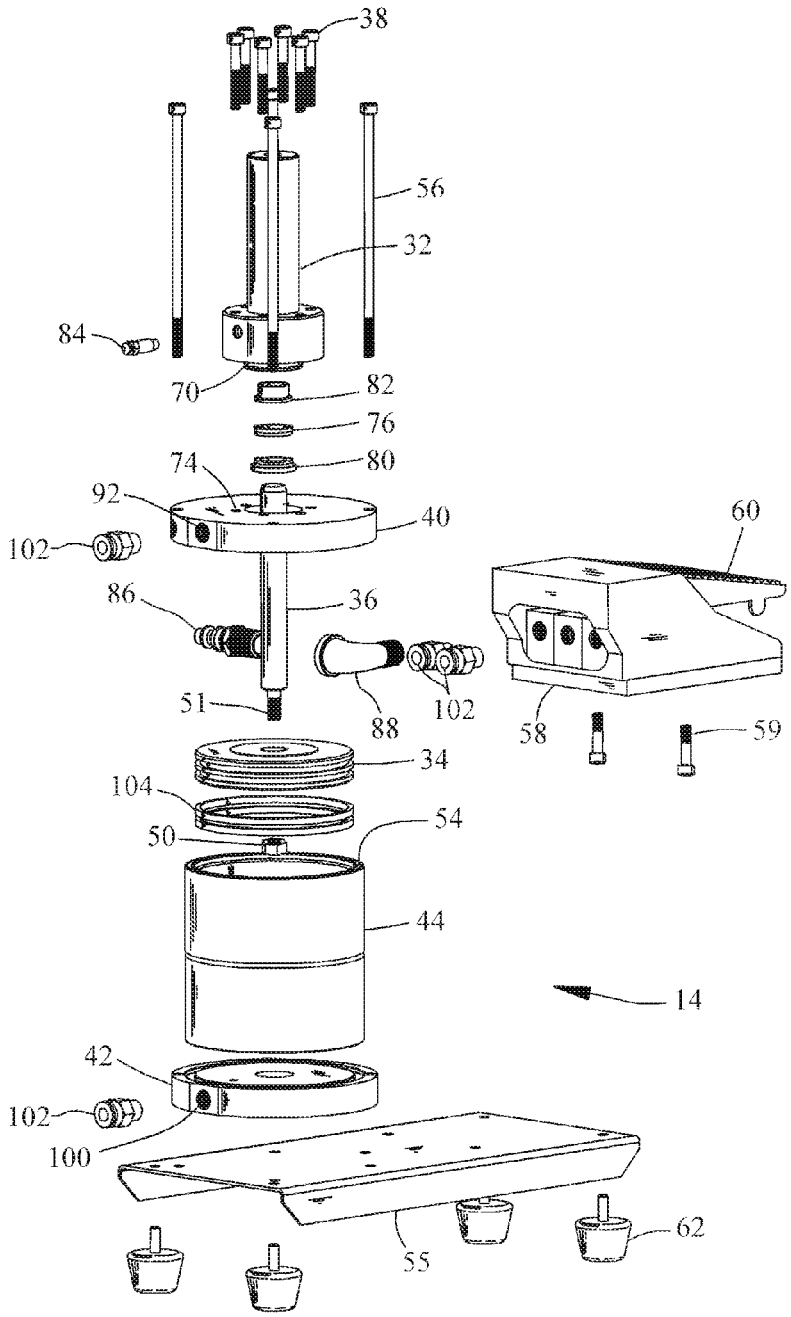
FIG. 4 is an exploded view of the pressure intensifier portion of the riveter shown in FIG. 1.
Figure 5:
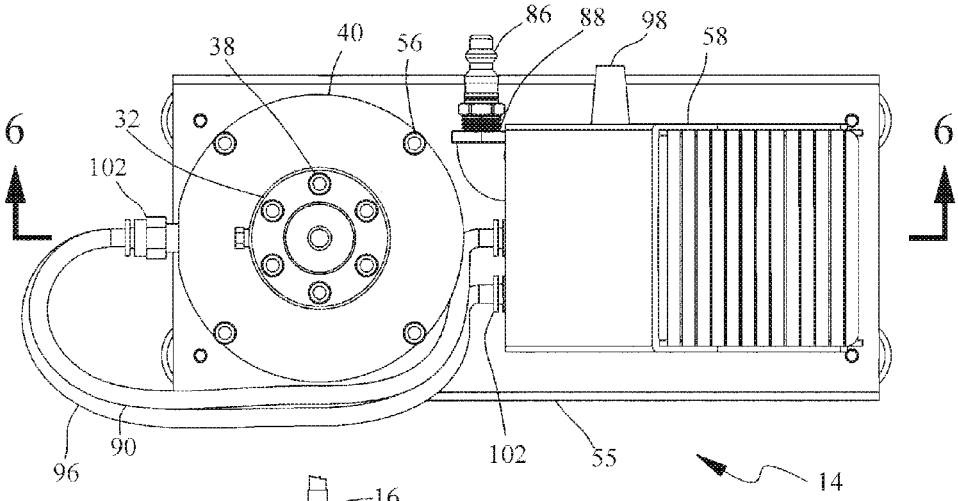
FIG. 5 is a top view of the pressure intensifier portion of the riveter shown in FIG. 1.
Figure 6:
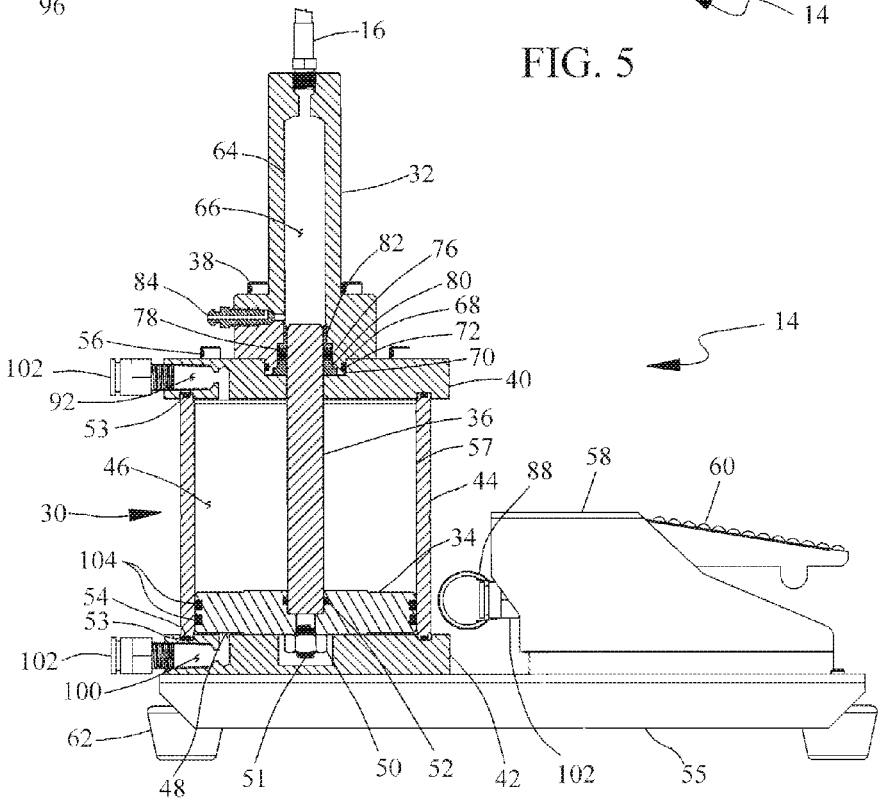
FIG. 6 is a partial sectional view of the pressure intensifier portion taken along cutting plane 6-6 of FIG. 5.

Referring to FIGS. 1, 4 and 5, the intensifier 14 primarily comprises cylindrical components including a low pressure housing assembly 30, a high-pressure housing 32, a low-pressure piston 34 and a high-pressure piston 36. The high pressure housing 32 is mounted to the low pressure housing assembly 30 with screws 38. Alternatively, the high pressure housing 32 and low pressure housing 30 may be integrally manufactured such as by casting. Referring to FIG. 6, the low pressure housing 30 is further comprised of a upper end cap 40, a lower end cap 42 and a cylinder 44, which together with the low-pressure piston 34 define two cavities; an upper retraction cavity 46 and a lower extension cavity 48. The low-pressure piston 34 and a high-pressure piston 36 are rigidly connected by a locking nut 50 on a threaded end 51 of the high-pressure piston 36. Air is prevented from leaking between these two parts by an o-ring 52 installed in a groove of the low-pressure piston 34. The upper end cap 40 and lower end cap 42 are sealed to the cylinder 44 by o-rings 53 in grooves 54 (FIG. 4) of the cylinder 44. The low pressure housing 30 is mounted to a base plate 55 by cap screws 56. The low pressure piston 34 is in axially slidable contact with an internal bore 57 of the cylinder 44. The housing assembly 30 is mounted in a vertical orientation as referenced to the ground, but may alternately be mounted in a horizontal position. A four port double acting control valve 58 is adjacent the housing assembly 30, and affixed to the base plate 55 with screws 59. Control of the valve 58 is accomplished via a foot pedal 60. Rubber pads 62 may be affixed to the bottom of the base plate 54, to help prevent the intensifier 14 from sliding on the floor.

Referring to FIG. 6, the high-pressure housing 32 has an inner bore 64 which is slightly larger than the diameter of the a high-pressure piston 36, so as to minimize wear on the piston 36 when it traverses the length of the housing 32. The high-pressure housing 32 and high-pressure piston 36 define a cavity 66 which contains the high pressure fluid. High pressure fluid is also contained in the flexible conduit 16. A high level of concentricity is achieved between the low pressure housing assembly 30 and high-pressure housing 32 by a close fit between a bore 68 of the upper end cap 40 and a cylindrical step 70 of the high-pressure housing 32. Concentricity between all moving parts is important to assure low seal wear. An o-ring 72 is used to seal air that would otherwise leak from the retraction cavity 46. The screws 38 that attach the high-pressure housing 32 to the low pressure housing assembly 30 are installed into threads 74 tapped into the upper end cap 40 (FIG. 4). For the intensifier presently designed, these threads collectively resist a separation force of approximately 600 lbf, created when the internal pressure of the fluid in the cavity 66 is elevated to approximately 3,000 psi. Typically an oil such as automotive transmission fluid, is sealed within the cavity 66 by a high pressure cup shaped seal 76. The high pressure seal 76 is oriented so that a cup on the seal 76 faces the fluid in the cavity 66, and expands as necessary to seal the fluid at elevated pressures. The seal 76 is retained in a bore 78 of the high-pressure housing 32 by a seal spacer 80. The high pressure piston 36 is guided by a bushing 82. The length of the piston 36 and housing 32 are set so as to achieve a desired swept volume in the cavity 66, which is slightly greater than the fluid volumetric requirements of the filler heads 12, 20 or 22.

In operation, the intensifier 14 is first filled with a hydraulic fluid, using a syringe or other device. The fluid volume of the system is on the order of 80 cc, so filling is relatively simple. Fluid is injected into a bleed fitting 84 located on the periphery of the high-pressure housing 32, until all unwanted trapped air is removed from the cavity 66 and the flexible conduit 16 and replaced with the fluid. The trapped air is allowed to escape from a similar bleed fitting located on the various forming heads 12, 20 or 22, and these heads can be filled with fluid in conjunction with filling the intensifier 14. Periodically it may be necessary to remove unwanted air which may begin to accumulate from repeated connections of the quick disconnects 17 and 18.

Next, pressurized air is supplied at approximately 90 psi to a conventional quick disconnect air fitting 86 (FIG. 5) installed into a pipe elbow 88, which is further installed in the double acting control valve 58. The foot operated valve 58 is spring energized, so that the pedal 60 on the valve 58 remains in an upper position. In the normal condition, pressurized air flows through the valve 58 and into a retraction air supply tube 90, which delivers the air to a port 92 in the upper end cap 40, and further into the retraction cavity 46. This normal condition ensures the low pressure piston 34 is fully retracted against the lower end cap 42 (as shown), and the high pressure piston 36 is thereby not exerting pressure on the fluid in the cavity 66. When it is desirable to create high fluid pressure in the cavity 66, the operator depresses the pedal 60 on the foot valve 58, causing compressed air to switch from pressurizing the air supply tube 90 to pressurizing an extension air supply tube 96. Since the valve 58 is double acting, air which had been pressurizing the cavity 46 is allowed to vent out of the valve 58 through a muffler 98. The compressed air pressurizing the supply tube 96 is routed to a port 100 in the lower cover 42 and into the extension cavity 48. The supply tubes 90 and 96 are connected to the valve 58 and low pressure housing 30 via quick air disconnects 102. The compressed air in the cavity 48 is now acting differentially on the lower side of the low pressure piston 34, exerting a force on the attached high pressure piston 36. The low pressure piston 34 has seals 104 which prevent compressed air from escaping the cavity 48 along the internal bore 57 of the cylinder 44. The area ratio of the low pressure piston 34 to the high pressure piston 36 is approximately 30:1. This ratio multiplies the input air pressure thereby creating a pressure within the high-pressure housing cavity 66 of approximately 3,000 psi. This fluid pressure provides the motive force for the forming heads 12, 20 and 22.

The C-yoke forming head 12, blind rivet forming head 20 and alligator forming head 22 of the present invention are comprised of similar components, and therefore similar components will use like item numbers in the figures and following descriptions. The C-yoke head 12 will be described in detail, with the alternate heads 20 and 22 described where they differ.

Figure 7:
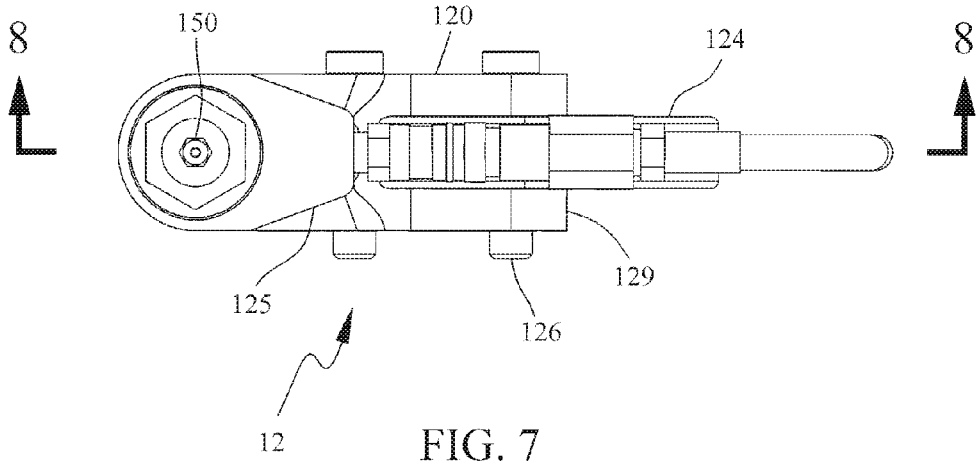
FIG. 7 is a top view of the C-yoke forming head shown in FIG. 1.
Figure 8:
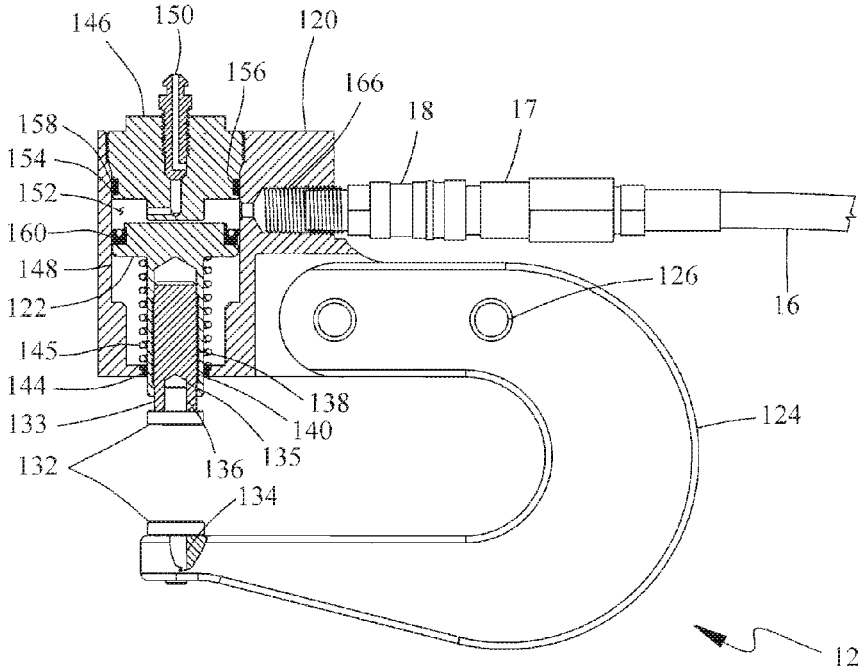
FIG. 8 is a partial sectional view of the C-yoke forming head taken along cutting plane 8-8 of FIG. 7.
Figure 9:
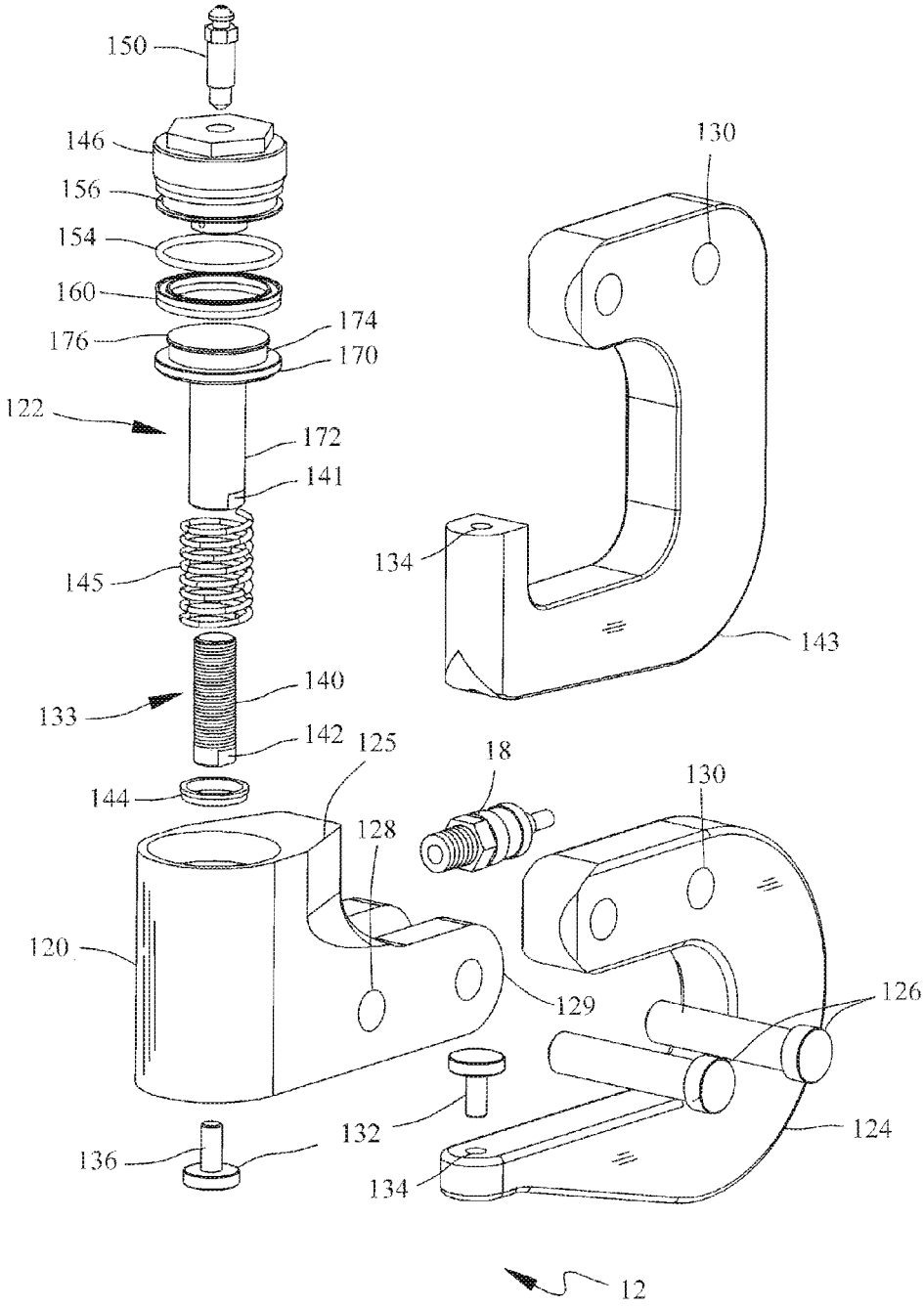
FIG. 9 is an exploded view of the C-yoke forming head shown in FIG. 1, with an example of an alternate C-yoke also shown.

Referring to FIGS. 7, 8 and 9 a C-yoke forming head 12 is used to compress a solid rivet, and is comprised of a generally rectangular piston housing 120, enclosing a high-pressure piston 122 and mounting a C-yoke 124. The housing 120 is shaped to ergonomically fit the user's hand, and is optimized to be as small and lightweight as practical. Referring to FIG. 7, the housing has a V-shaped end 125 which is intended to fit within the V formed by the thumb and forefinger of the user's hand. The piston 122 utilizes the fluid pressure delivered by the intensifier 14 to compress a solid rivet against the C-yoke 124. The C-yoke 124 is attached to the housing 120 by quick connect shear pins 126, located in close tolerance holes 128 in a clevis end 129 of the housing 120, and similarly spaced holes 130 in the C-yoke 124. The pins 126 carry shear forces created resisting a moment applied to the C-yoke 124 during compression of the rivet. A commercially available rivet die 132 is attached to the C-yoke 124 and a compression pin 133, and is useful for forming various rivet head shapes and sizes.

The C-yoke 124 and compression pin 133 have bores 134 and 135 respectively for receiving a shank 136 in the rivet die 132. The piston 122 and compression pin 133 have a threaded bore 138 and threaded shank 140 respectively, for adjusting the distance of the pin 133 relative to the piston 122. This threaded pair is used in turn to adjust the distance between the die 132 installed in the pin 133 and the die 132 installed in the C-yoke 124, to accommodate different rivet lengths. For the preferred embodiment, the thread pitch for the bore 138 and shank 140 is 32 threads per inch. Adjustment of the distance can be accomplished by a wrench flat 141 on the piston 122 and a wrench flat 142 on the pin 133. The piston 122 is guided in the housing 120 by a bushing 144. C-yokes come in different shapes in order to clear various structure. An alternate C-yoke 143, known as a flange C-yoke, is shown in FIG. 9. The forming head 12 further comprises a return spring 145, which assists in retracting the piston 122 following compression of the rivet. A threaded plug 146 is used to cover a bore 148 of the housing 120. The plug 146 may further comprise a bleed nipple 150, which is used to remove any unwanted air bubbles from the fluid in a cavity 152 defined by the extents of the piston 122, cylinder 148 and plug 146. Alternately the bleed nipple 150 may be installed in the housing 120. An o-ring 154 is installed in a groove 156 of the plug 146 to prevent fluid leakage past the wall of the bore 148. A backup ring 158 may be installed adjacent to the o-ring 154 to prevent extrusion of the o-ring 154. A high pressure cup shaped seal 160 is installed on the piston 122 to prevent fluid leakage from the cavity 152. The male disconnect 18 is installed in a tapered threaded port 166 of the housing 120.

Referring to FIG. 9, the piston 122 has a large diameter end 170 and a small diameter end 172. The large end 170 is used to convert the high fluid pressure in the cavity 152 into a compressive force, which will cause the piston 122 to move in axial alignment with the rivet being compressed. The large end 170 has a groove 174 which is used to retain the high-pressure seal 160. The seal 160 is retained in the groove 174 by a tapered lip 176, on the end of the piston 122. The diameter of the lip 176 is only slightly greater than the groove 174, in order to minimize distortion of the seal 160 during installation. The lip 176 is also tapered in order to further ease installation of the seal 160.

Figure 10:
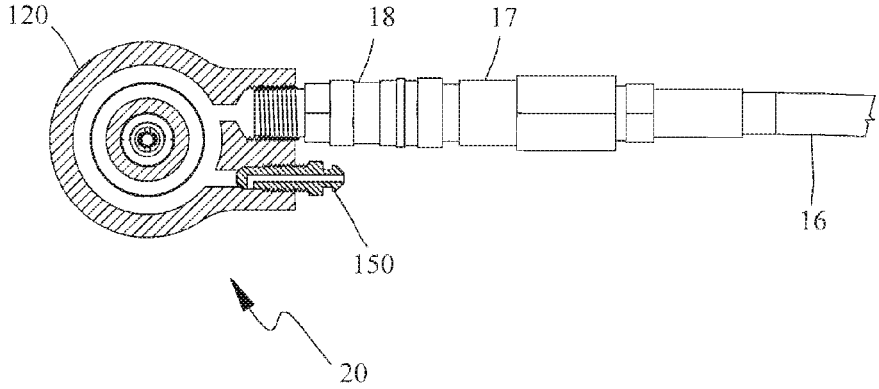
FIG. 10 is a partial sectional view of the blind rivet forming head taken along cutting plane 10-10 of FIG. 2.
Figure 11:
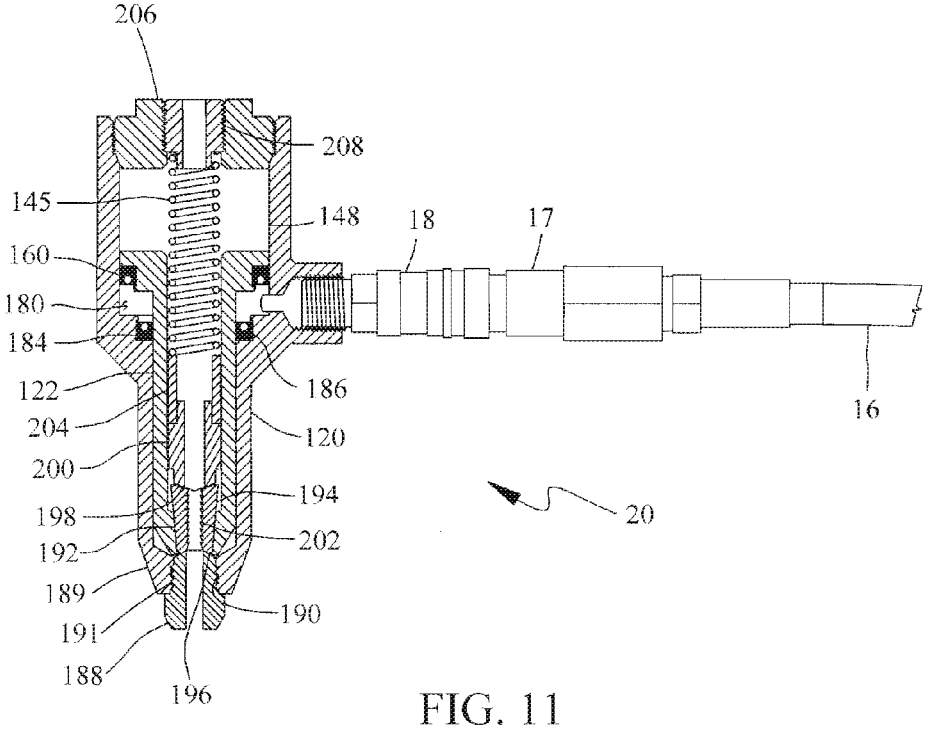
FIG. 11 is a partial sectional view of the blind rivet forming head taken along cutting plane 11-11 of FIG. 2.

The blind rivet forming head 20 depicted in FIGS. 2, 10 and 11 is comprised of components similar to the C-yoke forming head 12, such as a piston housing 120, a high pressure piston 122, a bleed fitting 150, and male disconnect 18. Note that the bleed fitting is installed in the housing 120. In operation, the blind rivet head 20 essentially works in reverse of the C-yoke head 12, whereby the high pressure piston 122 moves away from a blind rivet to be formed. This is accomplished by directing high pressure fluid from the intensifier 14 into a cavity 180 defined by the extents of the housing 120 and the piston 122. Fluid is contained within the cavity 180 by a high pressure piston seal 160 mounted on the piston 122, and a similar but smaller high pressure housing seal 184 restrained in a bore 186 of the housing 120. The high pressure fluid causes the piston 122 to move axially away from a nose-piece 188 mounted at a tip 189 of the housing 120. The nose-piece 188 is installed in the tip 189 by a threaded end 190 of the nose-piece 188 installed into a threaded bore 191 of the tip 189. As the piston 122 moves axially, an internal tapered bore 192 of the piston 122 comes into diametrical contact with a pair of tapered split jaws 194, forcing the jaws 194 to collapse radially inward about the stem of the blind rivet to be formed.

The split jaws 194 are initially held in a diametrically enlarged state, by a taper 196 on the nose-piece 188 and by a wedge 198 on a ram 200. This allows the blind rivet to be installed into the nose-piece 188, prior to forming. The ram 200 is forced by a spring 145 toward the nose-piece 188. The spring 145 also serves to return the piston 122 to a retracted state, once fluid pressure is removed. The jaws 194 have serrations 202 on an inner diameter, which serve to grasp the stem of the blind rivet. A hollow spacer 204 may be used to tailor the preload force applied to the ram 200 by the spring 145. A threaded plug 206 is used to close a housing bore 148, however unlike the plug 146 of the C-yoke head 12, this plug 206 does not seal fluid, and is used as a back stop for the spring 145. A threaded hollow spacer 208 may be used to fine adjust the preload force of the spring 145. The ram 200, spacer 204, plug 206 and threaded spacer 208 are hollow to allow the stem of the blind rivet to escape the forming head 20, once the rivet has been formed.

Figure 12:
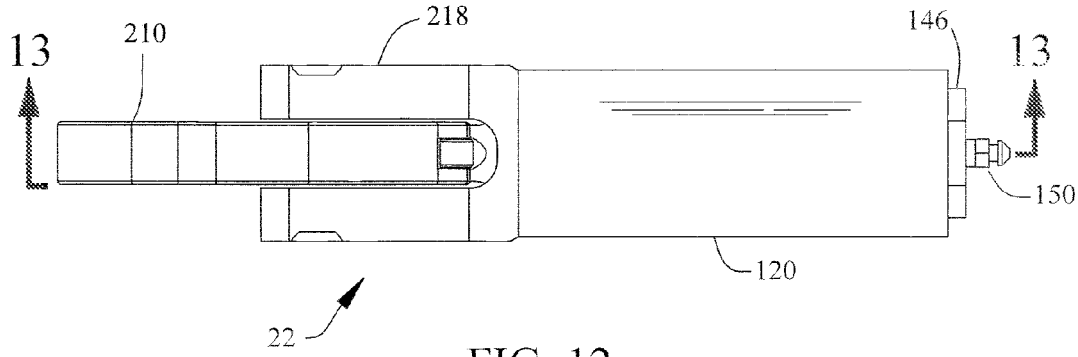
FIG. 12 is a top view of the alligator forming head shown in FIG. 3.
Figure 13:
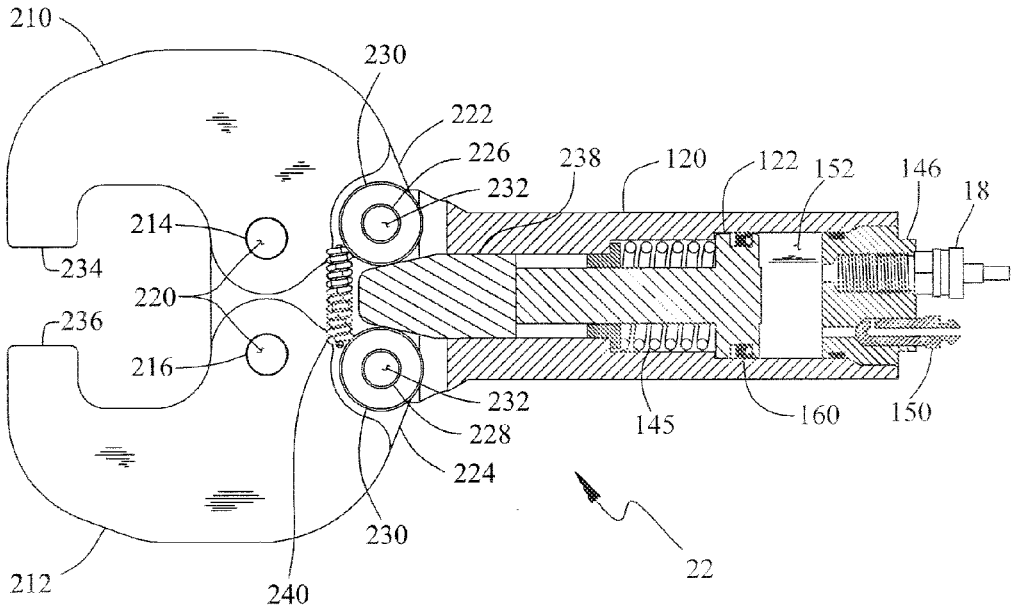
FIG. 13 is a partial sectional view of the alligator forming head taken along cutting plane 13-13 of FIG. 12.

The alligator forming head 22 depicted in FIGS. 3, 12 and 13 is comprised of components similar to the C-yoke forming head 12, such as a piston housing 120, a high pressure piston 122, a threaded plug 146, a high pressure seal 160, a bleed fitting 150, and male disconnect 18. Some of these components may be interchangeable between the various forming heads, which reduces acquisition cost. The alligator head 22 compresses a rivet via a set of rotatable jaws; an upper jaw 210 and a lower jaw 212. The upper jaw 210 and lower jaw 212 have a central bore 214 and 216 respectively, and are each pinned to a mount end 218 of the piston housing 120 by shear pins 220, which allows the upper jaw 210 and lower jaw 212 to pivot about their respective shear pins 220. The upper jaw 210 and lower jaw 212 have internal ends 222 and 224 respectively, that have axle bores 226 and 228 respectively. Roller bearings 230 are mounted to jaw internal ends 222 and 224 by shear pins 232. Jaws 210 and jaw 212 have external ends 234 and 236 respectively, which are used to compress the rivet to be formed.

In operation, the alligator head 22 is selectively coupled to the flexible conduit 16 which supplies fluid pressure from the intensifier 14. Fluid pressure from the conduit 16 acts on a surface of the piston 122, forcing the piston toward the jaws 210 and 212. The piston 122 contacts a tapered wedge 238, forcing the wedge 238 into the roller bearings 230 mounted on the jaw internal ends 222 and 224. The wedge 238 creates mechanical advantage, to force the jaws 210 and 212 to rotate about their respective central bores 214 and 216, thereby compressing a rivet installed between the internal ends 222 and 224. A jaw return spring 240 is used to cause the jaws 210 and 212 to rotate in an opposite direction once pressure from the cavity 152 is relieved and the piston 122 is returned to a refracted state by a piston return spring 145.

To those skilled in the art, it should be readily apparent that the invention described herein has significant advantages over existing tools in terms of size, weight and versatility. While the invention has been described in terms of various specific embodiments and use for forming rivets, those skilled in the art will recognize that the invention can be practiced with modification and alternative purpose within the spirit and scope of the claims.

What is claimed is:

1. A hydropneumatic riveter comprising a first body and a second body, said first body and said second body operably connected by a single, flexible conduit, said flexible conduit containing a fluid, said first body comprising a cylindrical bore into which a piston is installed for axially slideable engagement with said bore and acted on by the fluid of said conduit, said second body comprising a first piston and a second piston, said first piston having a substantially larger diameter than said second piston, said first piston actuated by a gas contained within said second body, said second piston compressing the fluid within said conduit, said riveter further comprising a control mounted to the second body for modulating said first piston.

2. The hydropneumatic riveter of claim 1 wherein said first body and said second body each further comprise a threaded bleed fitting, for selectively removing unwanted air from said fluid of said flexible conduit.

3. The hydropneumatic riveter of claim 1 wherein said first body and said flexible conduit each further comprise a portion of a fluid quick disconnect fitting for selectively coupling and uncoupling said first body from said flexible conduit.

4. The hydropneumatic riveter of claim 1 wherein said first body further comprises a C-shaped yoke.

5. The hydropneumatic riveter of claim 1 wherein said first body further comprises a plurality of split conical jaws, said split jaws having a portion of an internal diameter with serrations, and said piston of said first body further comprising a conical internal bore for interfacing with said split conical jaws.

6. The hydropneumatic riveter of claim 1 wherein said first body further comprises a first jaw and a second jaw, said first jaw and said second jaw oriented in the form of an alligator rivet squeezer.

7. The hydropneumatic riveter of claim 1 wherein said first body further comprises a compression spring for applying a preload to said piston.

8. The hydropneumatic riveter of claim 1 further comprising a threaded compression pin, wherein said piston of said first body comprises a threaded bore for selectively changing the distance between said piston and the threaded compression pin installed in said piston.

9. The hydropneumatic riveter of claim 1 wherein said control is a double acting valve.

10. The hydropneumatic riveter of claim 1 further comprising a base, wherein second body is mounted to the base and the control comprises a control valve that is manually operated by a foot pedal, the foot pedal also mounted to the base.

11. A hydropneumatic riveter comprising a first body and a second body, said first body and said second body operably connected by a single, flexible conduit, said first body comprising a piston oriented so as to move in a direction substantially parallel to a cylindrical axis of a fastener to be formed, said second body comprising a first piston and a second piston, said first piston having a substantially larger diameter than said second piston, said first piston actuated by a gas and acting on said second piston, said second piston compressing a fluid within said flexible conduit, said hydropneumatic riveter further comprising a control operatively connected to the second body and remotely positioned from the first body, the control operated to actuate the first piston of the second body thus compressing the fluid in the flexible conduit so as to move the piston of the first body.

12. The hydropneumatic riveter of claim 11 wherein said first body and said second body each further comprise a threaded bleed fitting, for selectively removing unwanted air from said fluid of said flexible conduit.

13. The hydropneumatic riveter of claim 11 wherein said first body and said flexible conduit each further comprise a portion of a fluid quick disconnect fitting for selectively coupling and uncoupling said first body from said flexible conduit.

14. The hydropneumatic riveter of claim 11 wherein said first body further comprises a C-shaped yoke.

15. The hydropneumatic riveter of claim 11 wherein said first body further comprises a plurality of split conical jaws, said split jaws having a portion of an internal diameter with serrations, said piston of said first body further comprising a conical internal bore for interfacing with said split conical jaws.

16. The hydropneumatic riveter of claim 11 wherein said first body further comprises a first jaw and a second jaw, said first jaw and said second jaw oriented in the form of an alligator rivet squeezer.

17. The hydropneumatic riveter of claim 11 wherein the control comprises a control valve that is manually operated by a foot pedal, the control valve coupled to the second body by at least one supply tube.

18. A hydropneumatic riveter comprising a first body and a second body, said first body and said second body operably connected by a single, flexible conduit, said first body comprising a cylindrical bore into which a piston is installed for axially slideable engagement with said bore and acted on by a fluid, said piston oriented so as to move in a direction substantially perpendicular to a cylindrical axis of a fastener to be formed, said second body comprising a first piston and a second piston, said first piston having a substantially larger diameter than said second piston, said first piston actuated by a gas and acting on said second piston, said second piston compressing a fluid within said flexible conduit and said second body comprising a control for modulating said first piston.

19. The hydropneumatic riveter of claim 18 wherein said first body and said second body each further comprise a threaded bleed fitting, for selectively removing unwanted air from said fluid of said flexible conduit.

20. The hydropneumatic riveter of claim 18 wherein said first body and said flexible conduit each further comprise a portion of a fluid quick disconnect fitting for selectively coupling and uncoupling said first body from said flexible conduit.

* * * * *